US011840982B2

(12) United States Patent
Jiang et al.

(10) Patent No.: US 11,840,982 B2
(45) Date of Patent: Dec. 12, 2023

(54) QUICK OIL RETURN CYLINDER LINER

(71) Applicant: MAHLE Automotive Technologies (China) Co., Ltd., Shanghai (CN)

(72) Inventors: Wentao Jiang, Shanghai (CN); Haixiao Chai, Shanghai (CN)

(73) Assignee: MAHLE Automotive Technologies (China) Co., Ltd.

( * ) Notice: Subject to any disclaimer, the term of this patent is extended or adjusted under 35 U.S.C. 154(b) by 0 days.

(21) Appl. No.: 18/088,366

(22) Filed: Dec. 23, 2022

(65) Prior Publication Data

US 2023/0204002 A1 Jun. 29, 2023

(30) Foreign Application Priority Data

Dec. 27, 2021 (CN) ..... 202111624979.6

(51) Int. Cl.
*F02B 75/08* (2006.01)
*F02F 1/00* (2006.01)
*F01M 11/02* (2006.01)

(52) U.S. Cl.
CPC ..... *F02F 1/004* (2013.01); *F01M 11/02* (2013.01); *F01M 2011/022* (2013.01)

(58) Field of Classification Search
CPC ..... F02F 1/20; F02F 1/004; F16J 9/203
USPC ..... 123/668
See application file for complete search history.

(56) References Cited

U.S. PATENT DOCUMENTS

2019/0338723 A1* 11/2019 Takeda ..... F02F 3/0069

FOREIGN PATENT DOCUMENTS

FR 1097144 A 6/1955
GB 483514 A 4/1938

OTHER PUBLICATIONS

German Search Report dated Jun. 7, 2023 for German Patent Application No. 10 2022 214 209.8.

* cited by examiner

*Primary Examiner* — Long T Tran
*Assistant Examiner* — James J Kim
(74) *Attorney, Agent, or Firm* — Fishman Stewart PLLC

(57) ABSTRACT

A quick return oil cylinder liner is disclosed. The cylinder liner includes an elongated cylindrical body having an outer surface and an inner surface defining a liner central axis extending between a first liner axial end and a second liner axial end. The inner surface is configured to form a combustion chamber with a piston and an engine housing. A quick oil return part is arranged on the inner surface of the cylinder liner corresponding to a non-skirt part of the piston. The oil return part is positioned below a position of the inner surface corresponding to an oil blade of an oil ring of the piston when the piston is positioned at a bottom dead center position. The oil return part extends to the second linear axial end and forms at opening at the second liner axial end.

20 Claims, 5 Drawing Sheets

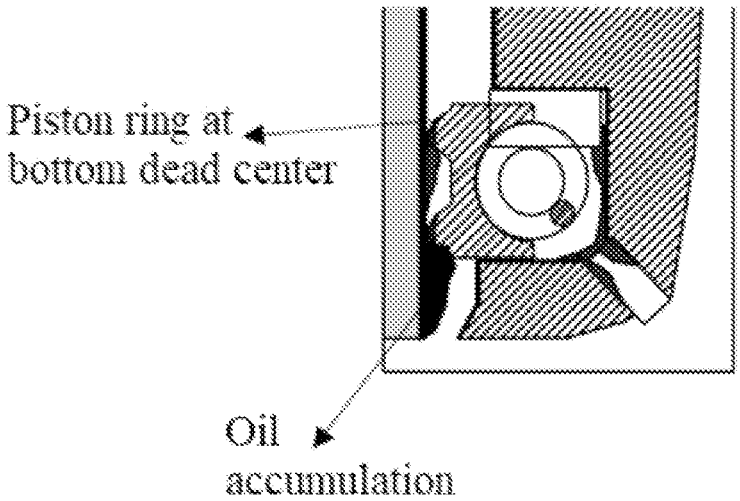
Fig. 5（a）

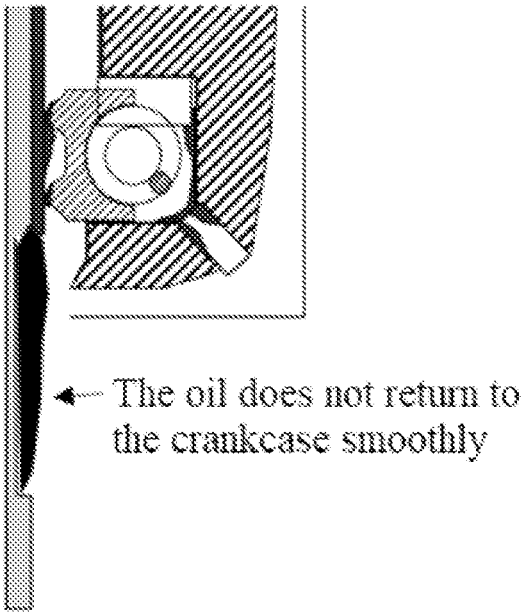
Fig. 5（b）
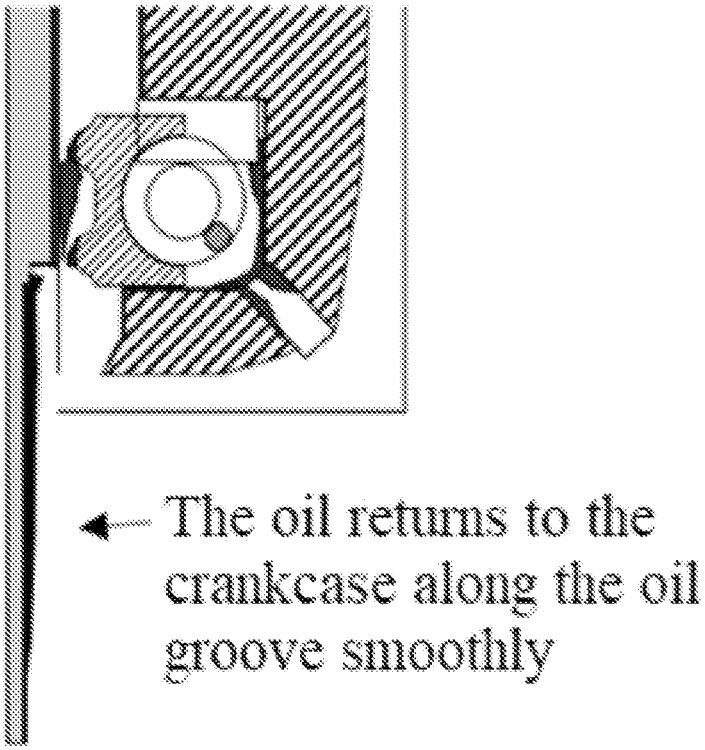
Fig. 5（c）

QUICK OIL RETURN CYLINDER LINER

CROSS-REFERENCE TO RELATED APPLICATION

This application claims priority to Chinese Application No CN 202111624979.6 filed on Dec. 27, 2021, the contents of which are hereby incorporated by reference in its entirety.

TECHNICAL FIELD

The invention relates to the technical field of engine accessories, in particular to an engine cylinder liner with a fast oil return groove.

BACKGROUND

In recent years, high explosive pressure and high power will be one of the main features of the next generation engine technology upgrading, and high explosive pressure and high power put forward more stringent requirements for engine durability. As one of the core components of the engine, the engine cylinder liner will face the challenge of higher durability and reliability requirements, as shown in FIG. 1, the current cylinder liner design. The inner diameter of the cylinder liner is a relatively smooth design with a certain honing reticle. The disadvantage of this design is that when the oil ring is scraped to the bottom dead center position, the oil accumulated under the oil ring cannot be released well, which will lead to the risk that the oil remaining on the cylinder liner will be scraped up. As an improvement, in the prior art, there is a scheme to set an oil return groove below the bottom dead center of the cylinder liner, as shown in FIG. 2, so that when the oil is scraped to the bottom dead center position, it flows into the oil return groove to avoid being brought back to the combustion chamber by the piston.

SUMMARY

In view of the above problems, the invention aims to solve at least one of the technical problems in the related technologies to a certain extent. For this reason, the invention provides a quick return cylinder sleeve, which can solve the technical problems in the prior art that the oil can not return to the oil pool in time after being scraped to the bottom dead center and accumulated.

In order to solve the above technical problems, the present invention adopts the following technical solutions:

The quick return cylinder liner is set as a slender cylinder with an outer surface of the cylinder liner and an inner surface of the cylinder liner. The central axis of the cylinder liner defined by the inner surface of the cylinder liner extends between the axial end of the first cylinder liner and the axial end of the second cylinder liner. The inner surface of the cylinder liner is configured to form a combustion chamber together with the piston and the engine housing. The piston is located in the cylinder liner and can move between the top dead center position and the bottom dead center position relative to the cylinder liner, The internal surface of the cylinder liner corresponding to the non skirt part of the piston is provided with a quick oil return part, that is, the oil return groove is only arranged on the internal surface of the cylinder liner corresponding to the piston pin shaft, and the internal surface of the cylinder liner corresponding to the piston skirt part is not provided with an oil return groove. Furthermore, the oil return part is located below the internal surface of the cylinder liner corresponding to the piston oil ring oil blade when the piston is at the bottom dead center position; The quick oil return part extends to the axial end of the second cylinder liner and forms an opening at the axial end of the second cylinder liner. This can effectively avoid the piston skirt being worn due to the impact of the swinging piston on the oil return groove in the prior art.

Further, the oil return part is provided with a plurality of oil return grooves extending to the axial end of the second cylinder liner along the central axis of the shaft sleeve. This is the main form of oil return section.

Further, the main section of the oil return groove is set as a rectangle with a depth of a and a width of b, and the spacing between two adjacent oil return grooves is c. As a preferred choice, the depth of the oil return groove $a>0.050$ mm, the width $b>1.0$ mm, and the spacing between the two adjacent oil return grooves c are set as follows: $1.0\ \text{mm}<c<4.3$ mm.

Furthermore, the shape of the front section near the combustion chamber side of the oil return groove should be set to make the accumulated lubricating oil easier to collapse into the oil return groove, which is semi-circular, square, elliptical, and other shapes conducive to the return of lubricating oil.

Furthermore, in order to make the lubricating oil flow into the oil return groove immediately in drops or strands, when setting the bottom dead center, it is particularly important that the distance between the corresponding position of the lower oil edge line of the oil scraper ring oil blade (i.e. the lowest side loop line formed by the oil blade contacting the cylinder liner) and the top point of the oil return groove is d. After repeated verification, the size of d is set to $1.75\ \text{mm}<d<4.3$ mm, which is most conducive to the return of lubricating oil.

Further, the distribution of the oil return part is defined numerically. The piston pin axis direction is set to 0-180°. According to the distribution of the piston skirt, the distribution range of the oil return part or oil return groove is 0-45°, 135°-225°, 315°-360°, and the number of oil grooves is ≥2.

Further, it may relate to a cylinder liner and a piston assembly, which comprises: Quick return cylinder sleeve as described above;

Piston, the piston is located in the cylinder liner, and can move between the top dead center position and the bottom dead center position relative to the cylinder liner, and includes an upper piston surface, a lower piston surface, and a lower piston surface forming a combustion surface.

The technical solution of the invention has at least the following beneficial effects:

1) Below the bottom dead center of the oil ring, the oil groove on the inner surface of the cylinder liner is designed to allow the oil scraped by the oil ring to flow back quickly along the oil groove, greatly reducing the risk of oil scraped on the cylinder liner.

2) The oil groove is set in the direction of the piston pin hole. Since the piston has no contact with the cylinder liner in the direction of the pin hole, when the piston moves to the bottom dead center, the piston pin hole direction is hollow, so there will be no contact between the piston and the cylinder liner in this direction, which has no impact on the piston performance. On the other hand, it is also conducive to the oil return effect of the engine oil.

3) The oil groove is arranged on the cylinder liner in the pin control direction to avoid the contact between the piston skirt and the oil groove when the oil groove is in the whole circumference. As the contact area of the oil groove decreases, the pressure on the contact surface of the piston skirt at the bottom dead center will increase, the piston skirt will be worn unevenly, and the piston skirt will scratch the piston skirt, which will lead to the risk of cylinder pulling over time.

4) The oil groove is connected to the bottom of the cylinder liner, which can release the oil in the oil groove to the crankcase and will not accumulate in the oil groove, thus avoiding the risk of the piston and crankshaft from channeling the oil accumulated at the bottom of the oil groove.

Additional aspects and advantages of the present application will be given in part in the following description, and some will become apparent from the following description, or will be learned from the practice of the invention.

BRIEF DESCRIPTION OF THE DRAWINGS

FIG. 5(*a*) shows a state of the lubricating oil without the provision of the oil returning groove in the prior art.

FIG. 5(*b*) shows the state of the lubricating oil after the non-opening oil return groove is provided.

FIG. 5(*c*) shows the state of the lubricating oil after the oil return grooves of the present embodiment are provided.

DETAILED DESCRIPTION

In order to make the objects, technical solutions and advantages of the embodiments of the present invention clearer, the technical solutions in the embodiments of the present invention will be clearly and completely described below with reference to the drawings in the embodiments of the present invention, and it is obvious that the described embodiments are some, but not all, embodiments of the present invention. All other embodiments, which can be obtained by a person skilled in the art without any inventive step based on the embodiments of the present invention, are within the scope of the present invention.

As understood by those skilled in the art, in a cylinder liner and piston assembly, the cylinder liner is an elongated cylindrical body having a liner outer surface and a liner inner surface defining a liner central axis extending between first and second axial liner ends, the piston moves in the engine liner between a Bottom Dead Center (BDC) position and a Top Dead Center (TDC) position, and to achieve lubrication, avoid dry-wear, form an oil-intake gap between the top ring and the liner, and to avoid oil from entering the combustion chamber and causing carbon deposits, an oil ring is provided on the piston to scrape the lubricating oil back into the crankcase sump as the piston travels down dead center, thereby limiting oil migration from the gap to the combustion chamber.

As noted in the background, the prior art cylinder liner and piston assemblies also suffer from certain drawbacks. For example, after the piston oil ring scrapes the lubricating oil back to the bottom dead center position, the lubricating oil flows back by gravity, but at the stage when the engine is just started or the temperature of the cylinder liner and the lubricating oil is not high, the flowing performance of the lubricating oil is poor, and the lubricating oil is accumulated on the cylinder liner at the bottom dead center position and is easily sucked back to the combustion chamber.

Figure 1:
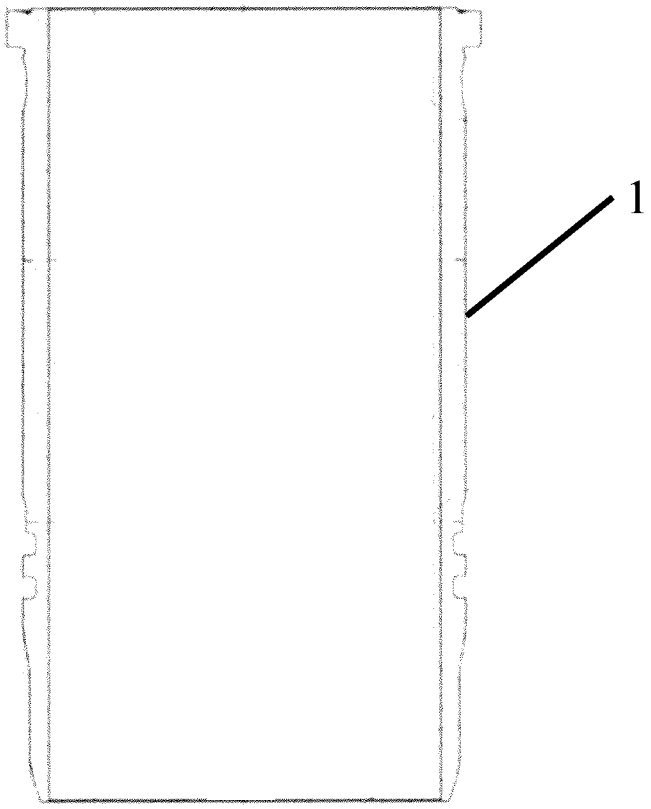
FIG. 1 is a side cross-sectional view of a prior cylinder liner design.

In the prior art, there is the cylinder liner structure as in FIG. 1, wherein, although it is the improvement to the lubricating oil film, in fact also produced certain influence to the oil return effect, like FIG. 5(*b*), lubricating oil flows back into the recess, the recess stores lubricating oil, for the FIG. 5(*a*) that does not have the oil return tank among the prior art, the risk of suck-back has been avoided to a certain extent, however, because the machine oil quantity that the recess holds is limited, after the groove structure is full of oil, oil drips gather outstanding cylinder liner internal surface again, at this moment, when the piston rises from the bottom dead center, oil drips outstanding at the oil groove bottom are taken back to the cylinder liner inner wall very easily, be unfavorable for lubricating oil backward flow crankcase oil bath.

Aiming at the problems, the cylinder sleeve structure is improved, oil is smoothly returned into the cylinder sleeve under the condition that the lubricating effect is ensured, and the problems of carbon deposition caused by lubricating oil flowing up to a combustion chamber and the like are avoided. See below for a description of specific embodiments.

Figure 2:
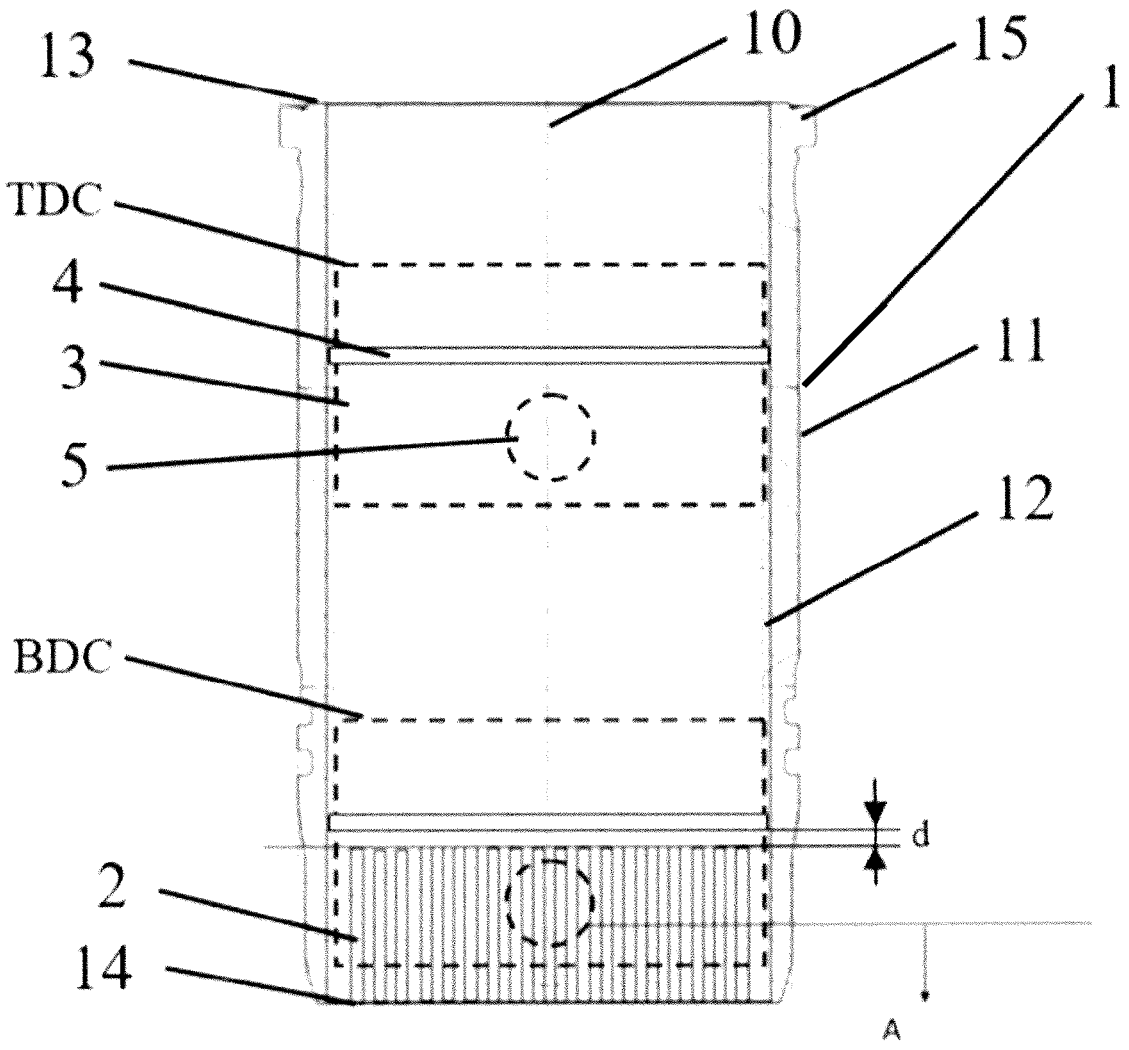
FIG. 2 is a side cross-sectional view of an embodiment of the present invention.
Figure 3:
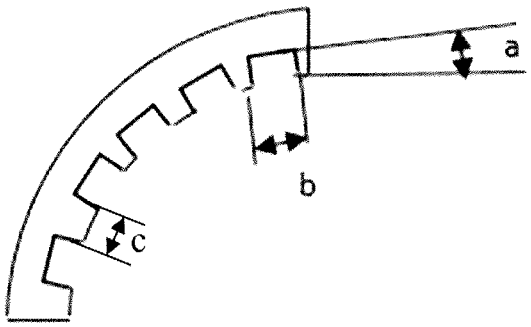
FIG. 3 is a layout of the cylinder liner oil grooves.

Referring to FIG. 1-2, in some embodiments of the present application, a cylinder liner with rapid oil return is provided for use in a cylinder liner and piston assembly of an engine to further improve oil return to the cylinder liner of the engine.

The cylinder liner 1 includes an elongated cylindrical body having a liner outer surface 11 and a liner inner surface 12, the liner inner surface 12 defining a liner central axis 10 extending between a first axial liner end 13 and a second axial liner end 14. The elongated cylindrical body further comprises a flange 15 protruding radially outwards on the first axial liner end 13. In FIG. 1, the inner surface 12 of the cylinder liner 1 provides a surface supporting the piston for reciprocating movement, the upper limit of piston travel being the Top Dead Centre (TDC) position and the lower limit being the Bottom Dead Centre (BDC), an oil-taking gap being formed between the piston and the liner, and an oil ring being provided on the piston for scraping lubricating oil back into the crankcase oil sump.

In the process of piston operation, the lubricating oil is scraped to the position of the lower dead point, the lubricating oil flows back to the oil pool of the crankcase along the wall of the shaft sleeve by means of gravity, however, the fluidity of the lubricating oil at low temperature is not enough to flow and drip back to the oil pool completely and smoothly.

As a solution, in order to smoothly guide the scraped-back lubricating oil to the oil return pool, as shown in FIG. 1, the present embodiment is provided with an oil return groove 2 of a groove structure at the bottom of the cylinder liner. The highest point of the oil return groove 2 in the direction of the central axis 10 is located at a position which is a distance d below a lower circular line where an oil edge of the oil ring contacts the inner surface 12 of the cylinder liner when the piston is at the bottom dead center position, that is, the highest point of the oil return groove 2 is just capable of receiving lubricating oil scraped from the inner surface 12 of the cylinder liner by the oil ring.

According to this, can effectual solution lubricating oil resorption's technical problem, however, need emphasize, the oil gallery of ring cloth on the cylinder liner, because it has reduced the area of contact of piston skirt portion and cylinder liner in the piston reciprocating motion process, and when the piston was swung in service, piston skirt and rough surface contact led to the fact piston skirt portion damage easily, led to the coating to drop, impaired piston skirt and cylinder liner contact further fish tail cylinder liner, serious lead to drawing the jar. Therefore, in the solution of the present embodiment, a quick oil return portion is provided on the inner surface of the cylinder liner corresponding to the non-skirt portion of the piston, that is, the oil return groove 2 is only provided on the inner surface 12 of the cylinder liner on the corresponding side of the piston pin, and the oil return groove 2 is not provided on the inner surface of the cylinder liner corresponding to the skirt portion of the piston, and is directly communicated with the second axial cylinder liner end surface 14 of the cylinder liner, so as to guide the lubricating oil to smoothly drop into the crankcase oil sump.

Figure 4:
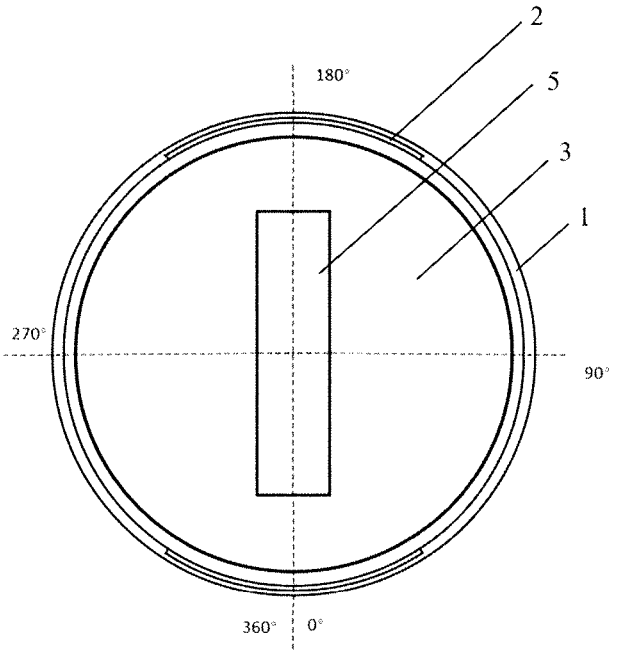
FIG. 4 is a diagram of oil groove dimensions.

For better understanding of the distribution of the sumps 2, the range of the sumps is described in terms of angles, as shown in FIG. 4: the direction of the pin shaft of the piston is 0-180 degrees, and the preferable distribution range of the oil return grooves 2 is 0-45 degrees, 135-225 degrees and 315-360 degrees according to the distribution of the piston skirt. The range can be properly adjusted according to different designs of the piston skirt, for example, the sizes of the main thrust surface and the auxiliary thrust surface of some pistons are different, so that the size design of the piston skirt is different, that is, the position range of the oil return groove can be flexibly adjusted according to the size of the piston skirt, and is, for example, 0-55 degrees, 125 degrees, 215 degrees, 325 degrees and 360 degrees. The maximum extent is limited by the absence of wear on the piston skirt.

In order to obtain more reasonable parameter data, reasonable experimental verification is indispensable, in this embodiment, the distance between the lower circular line of the contact between the oil blade of the oil ring and the inner surface 12 of the cylinder sleeve and the top end of the oil return groove 2 is d when the bottom dead center is set, and the front-view cross-sectional shape of the oil return groove close to the combustion chamber side is semicircular, square or oval, so as to form a shape setting which easily guides the backflow of the lubricating oil, and the experimental verification is performed on the size of d and the shape of the top of the oil return groove. In consideration of low-temperature fluidity and high-temperature viscosity of the lubricating oil, the most commonly used engine oil 5W-30 in automobiles is taken as the experimental lubricating oil. According to the fluidity research of the strand and drop of the lubricating oil at low temperature and high temperature, further, according to the thickness of the lubricating oil film and the thickness experiment result (the experiment process is not repeated) which can be influenced by the reciprocating motion process of the piston, the size of d is set to be in the range of 1.75 mm-4.3 mm, under the condition that d is 1.75 mm, the lubricating oil is scraped and accumulated by an oil ring, after the oil film is formed, redundant height forms flowing liquid flow, the strand and drop of the lubricating oil flow is timely collapsed into the groove 2, meanwhile, when the piston moves towards the upper dead center, because the distance between 1.75 mm and the oil ring and the residual ring bank is set reasonable, when the scraped lubricating oil forms oil drops or strands, namely when the piston stops at the lower dead center, the scraped lubricating oil flows into the oil return groove, the accumulated or accumulated height does not touch the side face of the piston, therefore, the generated return air flow, the lubricating oil is sucked back and brought back in a very small amount. However, when the distance between the oil return groove 2 and the oil ring is less than 1.75 mm, because the oil return groove 2 is closer to the oil ring and farther from the edge of the residual ring land, although the scraped lubricating oil flows into the oil return groove 2, the phenomenon of belt return is obvious due to the belt return air flow generated by the piston and the negative pressure generated by the oil ring, and the belt return phenomenon is more serious the closer the position is to the oil ring at the lower dead point.

When the oil is continuously moved downwards to the upper top point of the oil return groove 2 to the position 4.3 mm away from the oil ring at the bottom dead center of the inner surface of the cylinder sleeve, because the scraped lubricating oil forms oil drops higher than the oil film on the inner surface 12 of the cylinder sleeve or the flowing lubricating oil is highly contacted with the surface of the piston, the lubricating oil is accumulated on the cylinder sleeve in the two states, and the machine is easily brought back to the top dead center or even sucked back to a combustion chamber by the negative pressure generated by the sealing of the oil ring.

In order to further facilitate the flow of the lubricating oil into the oil return grooves 2 in consideration of the oil film forming and dripping properties of the lubricating oil, it should be clear that the depth a and the width b of the oil return grooves 2 and the distance c between two adjacent oil grooves are further set. The arrangement of the oil groove parameters of depth a and width b and the oil groove distance c is mainly based on the means that the accumulation of the lubricating oil into drops is still controlled, so that the lubricating oil can be timely collapsed and converged into a strand to flow down from the oil return groove 2 before the lubricating oil is accumulated into drops. FIG. 4 shows a cross-sectional view of the oil return groove 2, wherein the dimensions of the oil groove are defined as follows:

$a>0.050$ mm;

$b>1.0$ mm° the distance c between the two adjacent oil return grooves is set as follows:

$1.0$ mm$<c<4.3$ mm°

Experimental comparison can be generally referred to FIG. 5(*a*)-5(*c*) to show that the piston without oil return groove and provided with oil return groove runs to the bottom dead center, the storage and flowing state of the lubricating oil, FIG. 5(*a*) shows that the prior art has no oil return groove, and it can be seen that the lubricating oil scraped back from the inner surface of the cylinder liner is stored at the lower side of the bottom dead center oil ring and is easily subjected to the suck-back and the returning belt when the oil ring moves upwards.

FIG. 5(*b*) shows the state of the lubricating oil after the non-opening oil return groove is arranged, after the engine is operated, the oil ring scrapes the lubricating oil to the position below the position of the oil ring of the piston bottom dead center, and due to the oil return groove, the lubricating oil flows back to the oil return groove when being accumulated to drop or flow in a strand, and is accumulated in the oil return groove, and when the fluidity of the lubricating oil does not meet the expected requirement, the accumulation protrudes out of the cylinder sleeve. The lubricating oil droplets in such a suspended state are inevitably scraped and rewound by the negative pressure generated by the rising of the piston and the oil scraper ring.

FIG. 5(*c*) shows the state of the lubricating oil after the oil return groove is set in this embodiment, after the engine is operated, the oil ring scrapes the lubricating oil down to the lower side of the oil ring position of the piston bottom dead center, because the setting is reasonable, when the lubricating oil is stored up to be a drop or a strand and flows, the volume of the lubricating oil covers the oil return groove, so that the oil drops collapse to enter the oil return groove, smoothly flow into the oil return groove after being accumulated, and flow back to the crankcase along the oil return groove by gravity. This arrangement also avoids the back-scraping and back-banding that occurs in the arrangement of FIG. 5 (*b*).

The invention has not been described in detail and is in part known to those of skill in the art. Finally, it should be noted that: the above examples are only intended to illustrate the technical solution of the present invention, but not to limit it; although the present invention has been described in detail with reference to the foregoing embodiments, it will be understood by those of ordinary skill in the art that: the technical solutions described in the foregoing embodiments may still be modified, or some technical features may be equivalently replaced; and such modifications or substitutions do not depart from the spirit and scope of the corresponding technical solutions of the embodiments of the present invention.

The invention claimed is:

1. A quick return oil cylinder liner, comprising:

an elongated cylindrical body having an outer surface and an inner surface, the inner surface defining a liner central axis extending between a first liner axial end and a second liner axial end, the inner surface being configured to form a combustion chamber with a piston and an engine housing, the piston being located in the elongated cylindrical body and being movable relative to the liner between a top dead center position and a bottom dead center position, the piston being provided with an oil ring, a quick oil return part is arranged on the inner surface of the cylindrical body corresponding to a non-skirt part of the piston, and the quick oil return part is positioned below a position of the inner surface corresponding to an oil blade of the oil ring when the piston is positioned at the bottom dead center position;

wherein the quick oil return part extends to the second liner axial end and defines an opening at the second liner axial end; and wherein the quick oil return part comprises a plurality of oil return grooves extending along the central axis of the elongated cylindrical body to the second liner axial end.

2. The quick return oil cylinder liner according to claim 1, wherein a cross section of a main body of at least one of the plurality of oil return grooves is a rectangle with a depth and a width, and two adjacent oil return grooves of the plurality of oil return grooves have a distance.

3. The quick return oil cylinder liner according to claim 2, wherein the depth of the at least one oil return groove is more than 0.050 mm, the width is more than 1.0 mm, and the distance between the two adjacent oil return grooves is set as follows: 1.0 mm<c<4.3 mm.

4. The quick return oil cylinder liner according to claim 1, wherein at least one of the plurality of oil return grooves has a cross-sectional shape of a semicircular, square, or oval in front view close to the combustion chamber side.

5. The quick return oil cylinder liner according to claim 2, wherein a distance between a vertex of the at least one oil return groove and a lower circular line of the oil cutting edge of the oil ring contacting with the inner surface of the elongated cylindrical body at the bottom dead center of the piston is d, and the d is set as: 1.75 mm<d<4.3 mm.

6. The quick return oil cylinder liner according to claim 1, wherein a piston pin direction is 0-180 ° , according to the distribution of the piston skirt, the distribution range of the plurality of oil return grooves or the oil return portion is 0-45°, 135°-225°, 315°-360°, and a number of the plurality of oil grooves is greater than or equal to 2.

7. The quick return oil cylinder liner according to claim 1, wherein at least one of the plurality of oil return grooves has a depth of more than 0.050 mm and a width of more than 1.0 mm.

8. The quick return oil cylinder liner according to claim 1, wherein a distance between two adjacent oil return grooves of the plurality of oil return grooves is between 1.0 mm and 4.3 mm.

9. The quick return oil cylinder liner according to claim 1, wherein a distance between a vertex of at least one of the plurality of oil return grooves and a lower circular line of the oil cutting edge of the oil ring contacting with the inner surface of the elongated cylindrical body at the bottom dead center of the piston is d, and the d is set as: 1.75 mm<d<4.3 mm.

10. A cylinder liner and piston assembly, said assembly comprising:

a quick return cylinder liner, the quick return cylinder liner including:

an elongated cylindrical body having an outer surface and an inner surface, the inner surface defining a liner central axis extending between a first liner axial end and a second liner axial end, the inner surface being configured to at least partially define a combustion chamber; and a quick oil return part arranged on the inner surface of the cylindrical body;

a piston located in the quick return cylinder liner and moveable between a top dead center position and a bottom dead center position relative to the quick return cylinder liner;

wherein the quick oil return part is arranged on the inner surface of the cylindrical body corresponding to a non-skirt part of the piston, and the quick oil return part is positioned below a position of the inner surface corresponding to an oil blade of an oil ring of the piston when the piston is positioned at the bottom dead center position; and wherein the quick oil return part extends to the second liner axial end and defines an opening at the second liner axial end; and wherein the quick oil return part comprises a plurality of oil return grooves extending along the central axis of the elongated cylindrical body to the second liner axial end.

11. The cylinder liner and piston assembly according to claim 10, wherein a cross section of a main body of at least one of the plurality of oil return grooves is a rectangle with a depth and a width, and a distance is disposed between two adjacent oil grooves of the plurality of oil grooves.

12. The cylinder liner and piston assembly according to claim 11, wherein the depth of the at least one oil return groove is more than 0.050 mm.

13. The cylinder liner and piston assembly according to claim 11, wherein the width of the at least one oil return groove is more than 1.0 mm.

14. The cylinder liner and piston assembly according to claim 11, wherein the distance between the two adjacent oil return grooves is between 1.0 mm and 4.3 mm.

15. The cylinder liner and piston assembly according to claim 10, wherein at least one of the plurality of oil return grooves has a cross-sectional shape of a semicircle, a square, or an oval in front view close to the combustion chamber.

16. The cylinder liner and piston assembly according to claim 10, wherein a distance between a vertex of at least one of the plurality of oil return grooves and a lower circular line of the oil cutting edge of the oil ring contacting with the inner surface of the elongated cylindrical body at the bottom dead center position is between 1.75 mm and 4.3 mm.

17. The cylinder liner and piston assembly according to claim 10, wherein a piston pin direction is 0-180°, according to the distribution of the piston skirt, the distribution range of the plurality of oil return grooves is 0-45°, 135°-225°, 315°-360°, and a number of the plurality of oil return grooves is two or more.

18. The cylinder liner and piston assembly according to claim 11, wherein a piston pin direction is 0-180°, according to the distribution of the piston skirt, the distribution range of the plurality of oil return grooves is 0-45°, 135°-225°, 315°-360°, and a number of the plurality of oil return grooves is two or more.

19. The cylinder liner and piston assembly according to claim 12, wherein a piston pin direction is 0-180°, according to the distribution of the piston skirt, the distribution range of the plurality of oil return grooves is 0-45°, 135°-225°, 315°-360°, and a number of the plurality of oil return grooves is two or more.

20. The cylinder liner and piston assembly according to claim 13, wherein a piston pin direction is 0-180°, according to the distribution of the piston skirt, the distribution range of the plurality of oil return grooves is 0-45°, 135°-225°, 315°-360°, and a number of the plurality of oil return grooves is two or more.

* * * * *